US009169532B2

(12) United States Patent
Botelho et al.

(10) Patent No.: US 9,169,532 B2
(45) Date of Patent: Oct. 27, 2015

(54) PROCESS FOR THE IMPROVEMENT OF REDUCIBILITY OF ORE PELLETS

(71) Applicant: VALE S.A., Rio de Janeiro-RJ (BR)

(72) Inventors: Marcus Eduardo Emrich Botelho, Nova Lima (BR); Paulo Freitas Nogueira, Belo Horizonte (BR); Stephen Michael Potter, Belo Horizonte (BR)

(73) Assignee: VALE S.A., Rio de Janeiro (BR)

( * ) Notice: Subject to any disclaimer, the term of this patent is extended or adjusted under 35 U.S.C. 154(b) by 142 days.

(21) Appl. No.: 13/899,137

(22) Filed: May 21, 2013

(65) Prior Publication Data

US 2014/0096650 A1 Apr. 10, 2014

Related U.S. Application Data

(60) Provisional application No. 61/650,905, filed on May 23, 2012.

(51) Int. Cl.

| | |
|---|---|
| ***C22B 1/24*** | (2006.01) |
| ***C22B 5/12*** | (2006.01) |
| ***C21B 13/02*** | (2006.01) |
| ***C22B 1/243*** | (2006.01) |

(52) U.S. Cl.

CPC ..... *C22B 1/2406* (2013.01); *C21B 13/02* (2013.01); *C22B 1/243* (2013.01); *C22B 5/12* (2013.01)

(58) Field of Classification Search

CPC ..... C22B 1/2406; C22B 1/243; C22B 5/12; C21B 13/02

USPC ..... 75/505, 773

See application file for complete search history.

(56) References Cited

U.S. PATENT DOCUMENTS

| | | | | |
|---|---|---|---|---|
| 3,753,682 | A * | 8/1973 | Kohl | 75/479 |
| 4,089,681 | A * | 5/1978 | Gueussier | 419/28 |
| 4,490,174 | A * | 12/1984 | Crama et al. | 75/10.67 |
| 5,738,694 | A * | 4/1998 | Ford et al. | 44/553 |
| 2014/0260799 | A1 * | 9/2014 | Arvidsson et al. | 75/316 |

OTHER PUBLICATIONS

Machine translation of CN 101285129 A published Oct. 2008.*
Machine translation of SU 1836482 A3 published Aug. 1993.*
Derwent Acc No. 2008-O02833 for the patent family including CN 101285129 A published Oct. 2008.*
Derwent Acc No. 1995-137742 for the patent family including SU 1836482 A3 published Aug. 1993.*
Chinje, U.E., et al., "Effects of chemical composition of iron oxides on their rates of reduction: Part 1 Effect of trivalent metal oxides on reduction of hematite to lower iron oxides", Ironmaking and Steelmaking, vol. 16, No. 2, pp. 90-95 (1989).
El-Geassy et al., "Effect of Nickel Oxide Doping on the Kinetics and Mechanism of Iron Oxide Reduction", ISIJ International, vol. 35, No. 9, pp. 1043-1049 (1995).
Khalafalla, S.E., et al., "Promoters for Carbon Monoxide Reduction of Wustite", Transactions of Metallurgical Society of AIME, vol. 239, pp. 1484-1499 (Oct. 1967).

* cited by examiner

*Primary Examiner* — George Wyszomierski
*Assistant Examiner* — Tima M McGuthry Banks
(74) *Attorney, Agent, or Firm* — Arent Fox LLP

(57) ABSTRACT

A process for the improvement of reducibility of iron ore pellets including the steps of preparing a raw material mixture which contains metallic Ni powder, pelletizing the mixture obtained, burning the raw pellets and reducing the burnt pellets under reducing conditions in the presence of $CH_4$.

14 Claims, 3 Drawing Sheets

RUL Furnace

RUL Furnace

PROCESS FOR THE IMPROVEMENT OF REDUCIBILITY OF ORE PELLETS

This application claims priority from U.S. Patent Application No. 61/650,905, titled "Process for the improvement of reducibility of ore pellets," filed on May 23, 2012, and which is incorporated herein by reference in its entirety.

FIELD OF INVENTION

The present invention refers to a process for the improvement of reducibility of ore pellets from a catalytic effect generated by the addition of metallic Fe and/or Ni.

DESCRIPTION OF THE RELATED ART

Reducibility is a determining factor for the performance of metallic loads in traditional processes of primary iron production (Blast Furnace and Direct Reduction).

Reducibility is highly sensitive to temperature increase and thus, it is an even more important property for the direct reduction reactors, where the metallic load is reduced while still in solid state. In the direct reduction reactors, the maximum temperatures reached are lower than the melting temperature of iron and, therefore, lower than the ones which exist in the blast furnace, where a liquid phase is formed.

Reducibility of iron ore pellets intended for these processes depend basically on the characteristics of the iron oxide grain and the slag phase and intergranular porosity of the pellet. The intrinsic characteristics of the ores and additives, as well as chemical composition and burning conditions of the pellets are important factors for the physical and metallurgical qualities of this agglomerate.

By observing the pellets after basket tests in direct reduction reactors, it was noted that the pellets in contact with the material of the basket (stainless steel) presented an increased degree of reduction, thereby suggesting a catalytic effect of metallic Fe and/or Ni on reducibility.

In the literature, most of the studies related to the effect of additions on the reducibility of iron ore agglomerates refer to the use of calcium and magnesium oxide and there is very little information regarding the use of other materials to accelerate the reduction.

Khalafalla and Weston (S. E. Khafalla and P. L. Weston, Jr.; *Promoters for Carbon Monoxide Reduction of Wustite*; Transactions of Metallurgical Society of AIME; pgs. 1484 a 1499, Vol. 239; October 1967) studied the effect of alkaline metals and alkaline earth metals on FeO reduction in a CO atmosphere at the temperature of 1000° C., and they noted that small concentrations of these metals, approximately 0.7%, improved the reducibility of the FeO due to disturbances generated in the crystalline reticulate by interstitial ions with high atomic rays regarding Fe. Reducibility ratio with the quantity of additive was not linear, but it increased up to the maximum and then decreased. The maximum point depended on the nature and physical and chemical properties of the additive and the effect of those additions on the reducibility was directly proportional to the atomic ray and electrical load of the additive. The Ni atomic ray has the same magnitude as the Fe and, therefore, if any effect occurs, it should not be due to this mechanism of substitution.

Chinje and Jueffes (U. F. Chinje e J. H. E. Jueffes; *Effects of chemical composition of iron oxides on their rates of reduction: Part* 1 *Effect of trivalent metal oxides on reduction of hematite to lower iron oxides*; Ironmaking and Steelmaking; Pgs. 90 a 95; Vol. 16; No 2, 1989) evaluated the effect of trivalent metallic oxides, more specifically of Cr and Al, in the reduction of pure iron oxide, in an atmosphere with 18% CO/82% CO2 at 960° C., and concluded that Cr has a positive effect on the reduction of Fe oxide with additions varying from 1.6 to 5% and that this effect increases as their concentration increases. The hypothesis formulated to explain this effect is that Cr acts as a catalyst of the CO absorption process in the surface of the oxide, which is a characteristic of transition metals such as Ni.

El-Geassy et al. (El-Geassy et al.; *Effect of nickel oxide doping on the kinetics and mechanism of iron oxide reduction*; ISIJ International; pgs. 1043 a 1049; Vol. 35; N09, 1995) investigated the effect of NiO doping, varying from 1 to 10%, on the kinetics and reduction mechanisms of pure iron oxides in $H_2$ atmosphere and temperatures between 900 and 1100° C. and noted a positive and significant effect of that addition on the reduction. The reducibility increased in the initial and final stages of the process throughout the temperature range and this increase has been imputed to the formation of a nickel ferrite ($NiFe_2O_4$) and the increase of porosity of the sintered material.

SUMMARY OF THE INVENTION

In light of the above described results observed, the present invention describes an advantageous and effective process for the improvement of reducibility of ore pellets from an effect generated by the addition of metallic Fe and/or Ni.

More specifically, the present invention describes an advantageous and effective process for the improvement of reducibility of ore pellets comprising the following steps:

a) Preparing the raw material mixture, wherein the said mixture comprises:
   i. The iron ore powder of any kind;
   ii. Adding 0.4 to 0.7% of bentonite per total mass of the mixture;
   iii. Adding 1.00 a 5.00% of limestone per total mass of the mixture;
   iv. Adding 0.025 a 0.100% of Ni per total mass of the mixture from any source;
   v. Adding 0.025 a 0.100% of Fe per total mass of the mixture;
b) Pelletizing the mixture obtained at the end of step a) in a pelleting disk with addition of water and drying s;
c) Burning the raw pellet obtained from the step a) in a furnace under a oxidizing and temperature within the range of 1000° C. to 1400° C.;
d) Reducing the burnt pellets obtained from the step c) under reducing conditions with presence of $CH_4$.

A first aspect of the present invention refers to a significant positive effect of the metallic Ni content on the degree of metallization of the pellets reduced.

A second aspect of the present invention concerns to the fact that the addition of metallic Fe alone did not provide a significant effect on the degree of metallization of the pellets.

A third aspect of the present invention relates to the fact that the concomitant addition of metallic Fe and Ni has shown an additively property, the effect of the degree of metallization of pellets being the approximate average of the effects of individual elements.

Additional advantages and novel features of these aspects of the invention will be set forth in part in the description that follows, and in part will become more apparent to those skilled in the art upon examination of the following or upon learning by practice of the invention.

BRIEF DESCRIPTION OF THE DRAWINGS

Various example aspects of the systems and methods will be described in detail, with reference to the following Figures but not limited to, wherein.

DETAILED DESCRIPTION OF THE INVENTION

Figure 1:
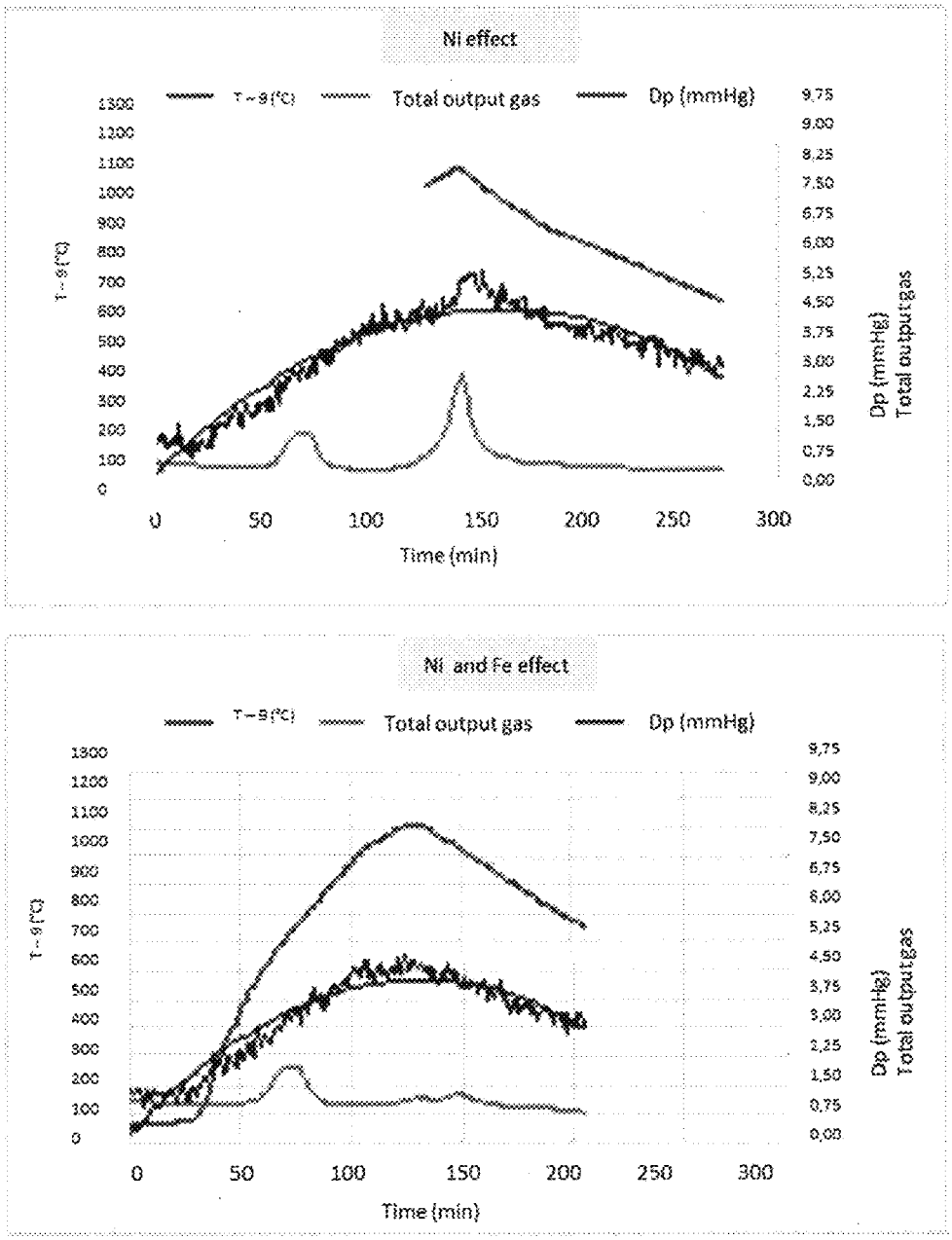
FIG. 1 is a graph illustrating the profiles of burning temperature, total output gas temperature and Dp of burnings of the Ni and Ni and Fe mixtures in the softening and melting furnace.
Figure 2:
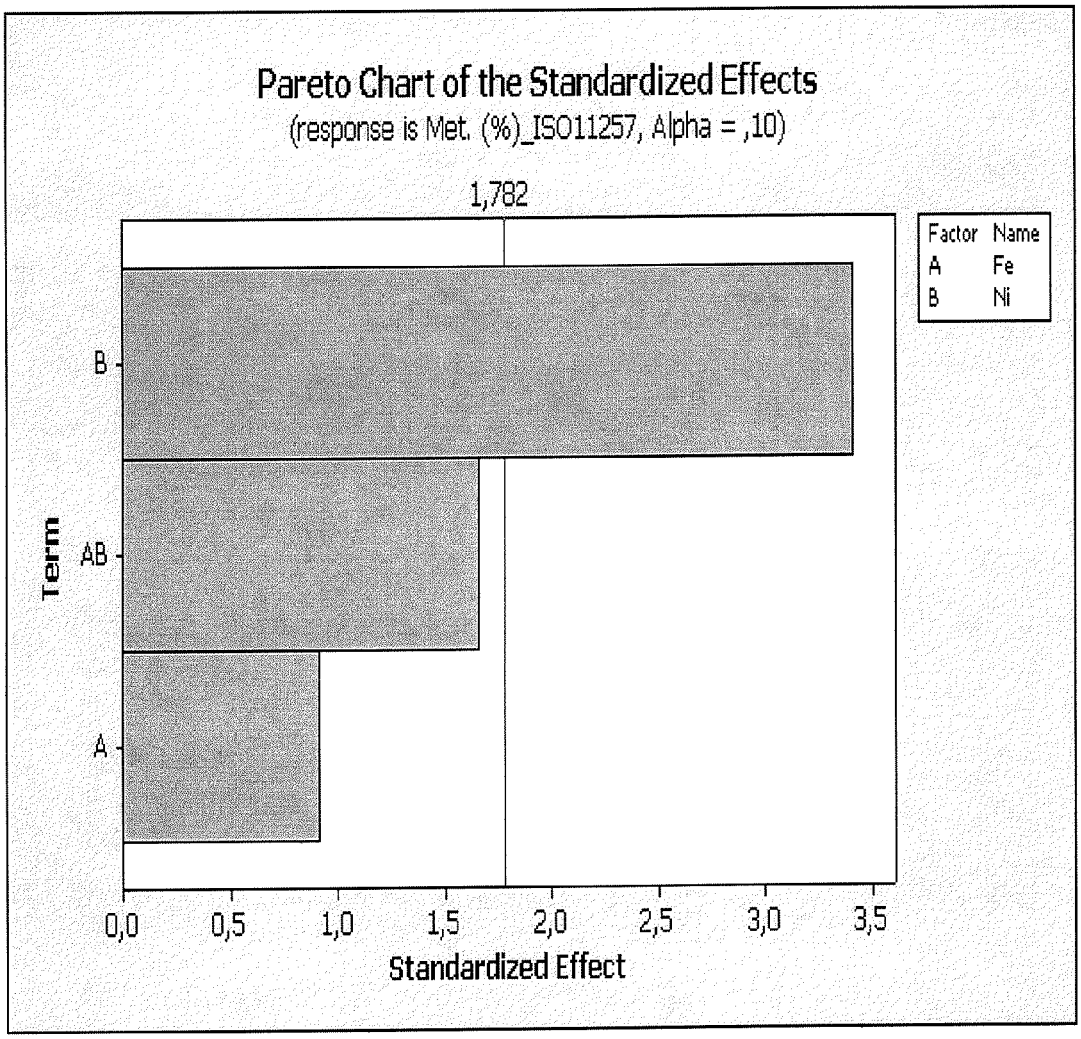
FIG. 2 is a chart regarding the effect of metallic % Fe and % Ni and interaction thereof.
Figure 3:
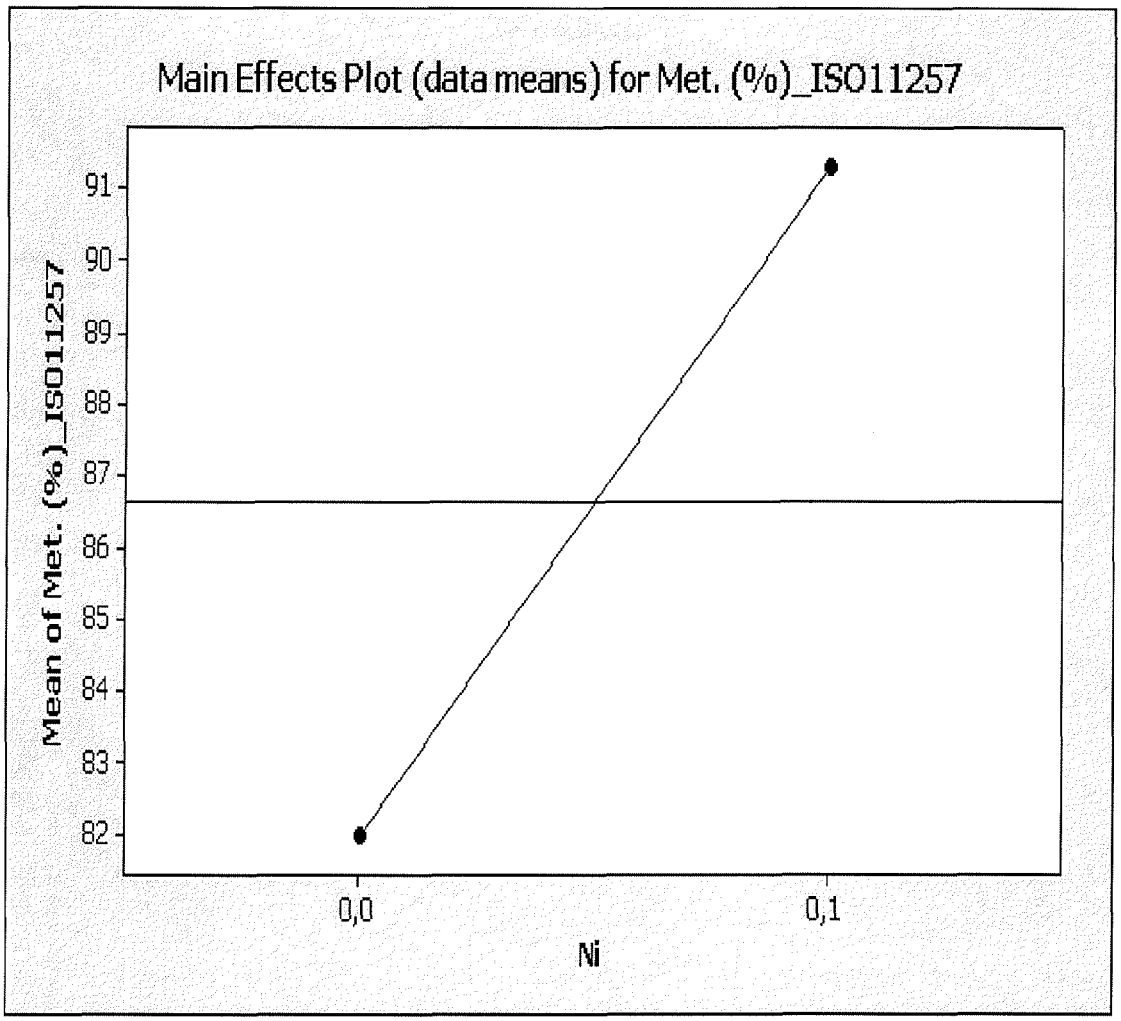
FIG. 3 is a chart illustrating the effect of the addition of Ni on the GM of iron ore pellets

The following detailed description does not intend to, in any way, limit the scope, applicability or configuration of the invention. More exactly, the following description provides the necessary understanding for implementing the exemplary modalities. When using the teachings provided herein, those skilled in the art will recognize suitable alternatives that can be used, without extrapolating the scope of the present invention.

According to the present invention it is described an advantageous and effective process for the improvement of reducibility of iron ores. More specifically, the said ore pellets consist in a mixture of raw materials which include ore iron, calcite limestone, betonite and metallic Ni and Fe powders, whose base chemical compositions are shown in Table 1 below.

TABLE 1

| Raw material chemical composition (%). Compounds (%) | | | | | | | | | | | | |
|---|---|---|---|---|---|---|---|---|---|---|---|---|
| Ore | Fe | $SiO_2$ | $Al_2O_3$ | MgO | CaO | $TiO_2$ | $Na_2O$ | $K_2O$ | Mn | P | Ni | PF |
| Iron ore | 66.12 | 1.97 | 0.61 | 0.03 | 0.01 | 0.04 | — | — | 0.13 | 0.04 | — | 1.34 |
| Bentonite | 5.41 | 60.71 | 14.80 | 0.024 | 1.181 | 2.44 | 1.92 | 0.676 | 0.024 | 0.024 | — | 6.599 |
| Calcite limestone | 0.25 | 1.66 | 0.51 | 0.22 | 53.3 | — | — | — | — | — | — | 42.26 |
| Met. Ni powder. | 0.09 | — | — | — | — | — | — | — | — | — | 99.81 | — |
| Met. Fe powder. | 99.91 | 0.09 | — | — | — | — | — | — | — | — | — | — |

Furthermore, the size fraction of the said materials which is lower than 0.044 mm is shown in Table 2 below.

TABLE 2

| % < 0.044 mm of raw materials. | | | | |
|---|---|---|---|---|
| Iron Ore | Bentonite | calcite limestone | Met. Ni powder | Met. Fe powder. |
| 85 to 95% | 70 to 90% | 70 to 90% | 85 to 95% | 85 to 95% |

In a preferred embodiment of the present invention, the percentage of iron ore which has the size fraction lower than 0.044 mm is 91.2%.

In another preferred embodiment of the present invention, the percentage of bentonite which has the size fraction lower than 0.044 mm is 74.4%.

In another preferred embodiment of the present invention, the percentage of calcite limestone which has the size fraction lower than 0.044 mm is 75.8%.

In another preferred embodiment of the present invention, the percentage of metallic Ni powder which has the size fraction lower than 0.044 mm is 91.0%.

In another preferred embodiment of the present invention, the percentage of metallic Fe powder which has the size fraction lower than 0.044 mm is 91.0%.

The present invention describes an advantageous and effective process for the improvement of reducibility of iron ore pellets comprising the following steps:

a) Preparing the raw material mixture, wherein the said mixture comprises:
   i. The iron ore powder of any kind;
   ii. Adding 0.4 to 0.7% of bentonite per total mass of the mixture;
   iii. Adding 1.00 a 5.00% of limestone per total mass of the mixture;
   iv. Adding 0.025 a 0,100% of Ni per total mass of the mixture from any source;
   v. Adding 0.025 a 0,100% of Fe per total mass of the mixture.
b) Pelletizing the mixture obtained at the end of step a) in a pelleting disk with addition of water and kiln-drying at 1100° C. for 2 hs;
c) Burning the raw pellets obtained from the step b) are burned in a vertical furnace RUL under a temperature within the range of 1000° C. to 1400° C.;
d) Reducing the burnt pellets obtained from the step c) under ISO11257 test conditions.

In a first preferred embodiment, the final composition of the raw material mixture comprises the following:

| Mixture (%) | | |
|---|---|---|
| Pellet mixture | Ore | 96.47 |
| | Bentonite | 0.50 |
| | Ni powder | 0.00 |
| | Fe powder | 0.10 |
| Estimated burnt pellet chemical composition | $Fe_t$ | 66.52 |
| | $SiO_2$ | 2.31 |
| | $AI_2O_3$ | 0.70 |
| | CaO | 1.62 |
| | MgO | 0.05 |
| | P | 0.04 |
| | Ni | 0.00 |
| | $CaO/SiO_2$ | 0.70 |
| | Ox. Bas./Ox.Aci. | 0.72 |

In a second preferred embodiment of the present invention, the dried raw pellets obtained at the end of the step b) have the size ranges from 5 to 18 mm. More preferably, the dried raw pellets obtained at the end of the step b) have the size from 10 to 12.5 mm.

In a third preferred embodiment, the raw pellets obtained from the step b) in a vertical furnace RUL under a temperature within the range of 1000° C. to 1400° C. More preferably, the raw pellets obtained from the step b) are burned in a vertical furnace RUL under a temperature within the range of 1000 to 1100° C.

The reducing step d) consists in submit the burnt pellets obtained from the step c) to ISO11257 pattern reducing conditions, as follows:

| STANDARD | | | ISO11257 |
|---|---|---|---|
| TEST CONDITION | Reduction pipe | | Horizontal |
| | Internal pipe | | 200 × 130 |
| | Heating/Stab. Gas | | N2 |
| | Temperature (° C.) | | 760 ± 10 |
| | Gaseous mixture composition (%) | H2 | 55% |
| | | CO | 38% |
| | | CO2 | 5% |
| | | CH4 | 4% |
| | | H2 | 0% |
| | Total Flow (L/min) | | 13 |
| | Cooling Gas | | N2 |

One of the advantages of the present invention consist that adding metallic Ni powder in order to improve the reducibility of the iron ore.

The invention claimed is:

1. A process for improvement of reducibility of iron ore pellets, comprising:

preparing a raw material mixture comprising:

iron ore powder;

0.4 to 0.7% of bentonite per total mass of the mixture;

1.00 to 5.00% of limestone per total mass of the mixture;

0.025 to 0.100% of Ni per total mass of the mixture; and 0.025 to 0.100% of Fe per total mass of the mixture;

pelletizing the raw material mixture in a pelleting disk with addition of water and drying to form raw pellets;

burning the raw pellets in a furnace under oxidizing conditions and at a temperature within a range of 1000° C. to 1400° C. to form burnt pellets; and reducing the burnt pellets under reducing conditions with $CH_4$.

2. The process according to claim 1, wherein the burning of the raw pellets further comprises burning in a vertical furnace, and wherein a temperature is within a range of 1000 to 1100° C.

3. The process according to claim 1, wherein the iron ore powder comprises about 66.12 wt % iron.

4. The process according to claim 1, wherein the iron ore powder comprises about 1.97 wt % silicon dioxide, about 0.61 wt % aluminum oxide, about 0.03 wt % magnesium oxide, about 0.01 wt % calcium oxide, about 0.04 wt % titanium oxide, about 0.13 wt % manganese, and about 0.04 wt % phosphorus.

5. The process according to claim 1, wherein about 91.2 wt % of the iron ore powder has a size fraction of less than about 0.044 mm.

6. The process according to claim 1, wherein the raw pellets have a size of about 5 to about 18 mm.

7. The process according to claim 1, wherein the raw pellets have a size of about 10 to about 12.5 mm.

8. The process according to claim 1, wherein the reducing conditions are in accordance with ISO11257 pattern reducing conditions.

9. The process according to claim 1, wherein the reducing conditions comprise at least one condition selected from a group consisting of a horizontal reduction pipe, an internal pipe, a nitrogen heating or stabilizing gas, a temperature of about 750 to 770° C., a gaseous mixture composition of 55 wt % hydrogen, 38 wt % carbon monoxide, 5 wt % carbon dioxide and 4 wt % methane, a total flow rate of 13 L/min, and a nitrogen cooling gas.

10. The process according to claim 1, wherein about 74.4 wt % of the bentonite has a size fraction of less than about 0.044 mm.

11. The process according to claim 1, wherein about 75.8 wt % of the limestone has a size fraction of less than about 0.044 mm.

12. The process according to claim 1, wherein about 91.0 wt % of the nickel has a size fraction of less than about 0.044 mm.

13. The process according to claim 1, wherein about 91.0 wt % of the iron has a size fraction of less than about 0.044 mm.

14. The process according to claim 1, wherein the Ni is obtained from Ni powder.

* * * * *